US009746152B2

(12) United States Patent
Poole et al.

(10) Patent No.: US 9,746,152 B2
(45) Date of Patent: Aug. 29, 2017

(54) ILLUMINATED RAIL

(71) Applicants: Wayne Gerard Poole, Alexandria, VA (US); Steven Carl Anderson, Woodbridge, VA (US)

(72) Inventors: Wayne Gerard Poole, Alexandria, VA (US); Steven Carl Anderson, Woodbridge, VA (US)

( * ) Notice: Subject to any disclaimer, the term of this patent is extended or adjusted under 35 U.S.C. 154(b) by 0 days.

(21) Appl. No.: 14/545,405

(22) Filed: May 1, 2015

(65) Prior Publication Data

US 2016/0320015 A1 Nov. 3, 2016

(51) Int. Cl.

| | |
|---|---|
| ***B63B 45/06*** | (2006.01) |
| ***F21V 3/04*** | (2006.01) |
| ***B63B 45/04*** | (2006.01) |
| ***F21V 33/00*** | (2006.01) |
| ***E04F 11/18*** | (2006.01) |
| ***B63B 17/04*** | (2006.01) |
| *F21V 3/02* | (2006.01) |
| *F21V 23/04* | (2006.01) |
| *F21W 101/04* | (2006.01) |
| *F21W 111/08* | (2006.01) |
| *F21Y 103/10* | (2016.01) |
| *F21Y 115/10* | (2016.01) |
| *F21Y 113/13* | (2016.01) |

(52) U.S. Cl.

CPC ..... *F21V 3/0436* (2013.01); *B63B 17/04* (2013.01); *B63B 45/04* (2013.01); *E04F 11/1804* (2013.01); *F21V 33/00* (2013.01); *F21V 33/006* (2013.01); *E04F 2011/1872* (2013.01); *F21V 3/02* (2013.01); *F21V 23/0435* (2013.01); *F21W 2101/04* (2013.01); *F21W 2111/08* (2013.01); *F21Y 2103/10* (2016.08); *F21Y 2113/13* (2016.08); *F21Y 2115/10* (2016.08)

(58) Field of Classification Search

CPC ..... F21Y 2103/003; F21S 4/20; F21S 4/22; F21S 4/28; B63B 45/06

See application file for complete search history.

(56) References Cited

U.S. PATENT DOCUMENTS

| | | | | |
|---|---|---|---|---|
| 6,231,217 | B1 * | 5/2001 | Krippelz, Sr. | B60Q 1/32 114/15 |
| 6,474,851 | B1 * | 11/2002 | Baley | A01K 79/02 114/255 |
| 6,802,634 | B1 * | 10/2004 | Pan | F21S 4/20 362/219 |
| 7,132,785 | B2 * | 11/2006 | Ducharme | F21K 9/00 313/485 |
| 7,291,852 | B1 * | 11/2007 | Matlack | A01K 97/00 250/365 |
| 7,390,044 | B2 | 6/2008 | Marquez | |
| 7,575,499 | B2 * | 8/2009 | Tufte | G09F 13/22 362/511 |

(Continued)

*Primary Examiner* — Julie Bannan

(57) ABSTRACT

An internally illuminated transparent rail, such as a handrail, is disclosed. The rail is fabricated from polycarbonate or the like, and contains one or more series of lighting elements such as LEDs. The LEDs are connected to a programmable controller which stores preloaded programming control sequences and features, and which can also receive commands wirelessly from e.g. a hand held user interface such as a cellular telephone. The rail includes stanchions for mounting to an environmental object such as a transport vehicle or a static structure.

17 Claims, 3 Drawing Sheets

(56) References Cited

U.S. PATENT DOCUMENTS

| | | | | |
|---|---|---|---|---|
| 7,926,975 | B2 * | 4/2011 | Siemiet | F21S 4/28 362/240 |
| 8,678,626 | B1 | 3/2014 | Hickman | |
| 8,740,433 | B2 | 6/2014 | Smith | |
| 8,840,263 | B1 * | 9/2014 | Jones | A41D 13/01 362/108 |
| 2005/0152145 | A1 | 7/2005 | Currie et al. | |
| 2007/0008732 | A1 | 1/2007 | Robertson et al. | |
| 2009/0016046 | A1 * | 1/2009 | Witsenburg | A47F 11/10 362/145 |
| 2009/0027916 | A1 * | 1/2009 | Huang | F21K 9/17 362/581 |
| 2010/0110681 | A1 * | 5/2010 | Wilcox | B63B 45/04 362/235 |
| 2010/0118557 | A1 * | 5/2010 | Ortwein | B60Q 1/32 362/477 |
| 2011/0228517 | A1 * | 9/2011 | Kawabat | F21K 9/00 362/84 |
| 2013/0093359 | A1 * | 4/2013 | Hsu | F21V 19/003 315/312 |

* cited by examiner

ILLUMINATED RAIL

FIELD OF THE DISCLOSURE

The present disclosure relates to rails intended to be mounted to vehicles and static structures, for example to facilitate hand grasp by a person.

BACKGROUND

Rails are provided on vehicles such as boats and on static structures such as staircases to afford a handhold for people using the vehicles and structures. Rails are located where people are moving from one area to the next, and are in need of a steadying or supporting aid.

Beyond providing physical support where people are moving, vehicles and static structures may also have a need for visual communications, such as signage, warning lights, and others.

SUMMARY

Rails have a potential to serve as support platforms for lighting which may play a role in signage and warning lights, as well as providing for steadying and physically supporting roles. To this end, rails may be adapted for both being gripped by hand and also for exploiting their frequently hollow interiors to support lighting. If transparent or translucent, rails may serve as homes for static and dynamic lighting displays as well as handles for providing steadying and support roles.

The present disclosure therefore proposes internally illuminated rails capable of being attached to an object such as a transport vehicle or static structure. Formed from a suitable material such as a polycarbonate plastic, a resulting rail is strong enough to withstand use as a handhold, and also as a housing for a series of lighting elements. Combined with a programmable controller located in a sheltered place, rails originally provided for handholds can serve as illuminated signs and light bars, such as those placed on emergency motor vehicles.

BRIEF DESCRIPTION OF THE DRAWINGS

Various objects, features, and attendant advantages of the disclosed concepts will become more fully appreciated as the same becomes better understood when considered in conjunction with the accompanying drawings, in which like reference characters designate the same or similar parts throughout the several views, and wherein.

DETAILED DESCRIPTION

Figure 1:
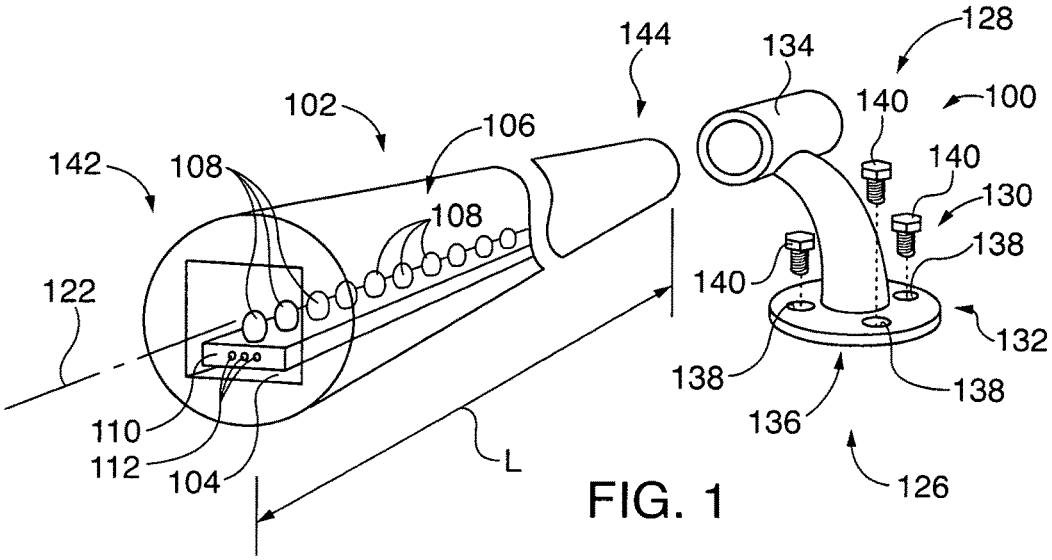
FIG. 1 is a diagrammatic, perspective, partially exploded view of an illuminated rail, according to at least one aspect of the disclosure.
Figure 3:
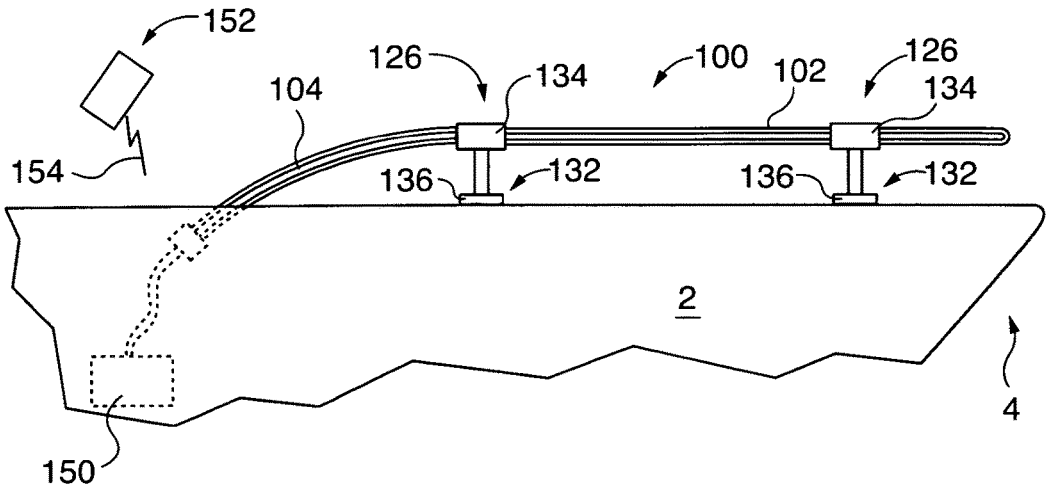
FIG. 3 is a side environmental view of an illuminated rail mounted to a boat, according to at least one aspect of the disclosure.

Referring first to FIG. 1, according to at least one aspect of the disclosure, there is shown an illuminated rail 100 for attachment to an object (see FIG. 3). The illuminated rail 100 comprises a hollow plastic tube 102 having a length L and comprising an through passage 104 extending continuously through the hollow plastic tube 102 and continuously along the length L of the hollow plastic tube 102. At least one first series 106 of active lighting elements 108 is located within and extends along the through passage 104 of the hollow plastic tube 102. The at least one first series 106 of active lighting elements 108 includes at least one first supporting substrate 110 on which each one of the first series 106 of active lighting elements 108 is mounted. An electrical circuit 112 is electrically connected to each one of the series 106 of active lighting elements 108 and is located within and extends along the through passage 104 of the hollow plastic tube 102.

Unless otherwise indicated, the terms "first", "second", etc., are used herein merely as labels, and are not intended to impose ordinal, positional, or hierarchical requirements on the times to which these terms refer. Moreover, reference to, e.g., a "second" item does not either require or preclude the existence of, e.g., a "first" or lower-numbered item, and/or, e.g., a "third" or higher-numbered item.

The hollow plastic tube 102 is translucent (which will be understood to encompass transparency), and may be fabricated from a polycarbonate plastic, for example. The hollow plastic tube 102 may be fabricated by any suitable method, such as extrusion, three dimensional printing, by fusing together constituent strips of polycarbonate plastic, or in any other suitable way. Where utilized, strips of polycarbonate plastic may be fused by ultrasonic welding or heat.

The through passage 104 leaves an open channel into which one or more series 106 of active lighting elements 108 may be inserted. Lighting elements 108 are said to be active if they are connected to power and control signals, and can be illuminated to create a lighted display at the discretion of the user. It would be possible to utilize all of the lighting elements 108 as active, or alternatively, to leave at least one lighting element 108 unused. The unused lighting element 108 may serve as a spare, or may activated when desired. Lighting elements 108 may be light emitting diodes, for example. Each each one of the first series 106 of active lighting elements 108 comprises a multicolor light emitting diode (LED). Such LEDs may be controlled such that each emits light selectively of different colors. This minimizes the number of LEDs that must be provided and mounted on the first supporting substrate 110. The second series 116 of active lighting elements 108 may be identical in type and function.

By light emitting diode (LED), it is meant LED assemblies comprising a discrete lens projecting well above the supporting substrate, as illustrated in FIG. 1.

Polycarbonate is one of a number of constituent materials which may be utilized to form the hollow plastic tube 102. Other materials which may be substituted include other transparent or translucent plastics, such as acrylic plastics.

Polycarbonate is readily commercially available, is readily extruded, is strong enough to serve as a hand hold which may have to support the full weight of several people, and is transparent or translucent.

Lighting elements 108 arrayed along the length L of the hollow plastic tube 102 are readily visible therethrough, and do not interfere with the function of the rail 100 as a hand hold. Lighting elements 108 may be mounted to the supporting substrate 110 to facilitate assembly of the rail 100. The supporting substrate 110 is sufficiently strong to support the individual lighting elements 108, and to contain necessary electrical conductors (not shown). The supporting substrate 110, which may be slightly bendable, is also rigid enough to be readily insertable into and through the hollow plastic tube 102 for all of the length L of the latter. The electrical circuit 112 is contained within the supporting substrate 110 in the assembly. The electrical circuit 112 is shown only schematically, and will be understood to include individual conductors in numbers and sizes necessary to accomplish the described functions. Also, electrical insulation and resistors and other electronic control components (none shown) are enclosed within or otherwise made integrally with the assembly.

Figure 2:
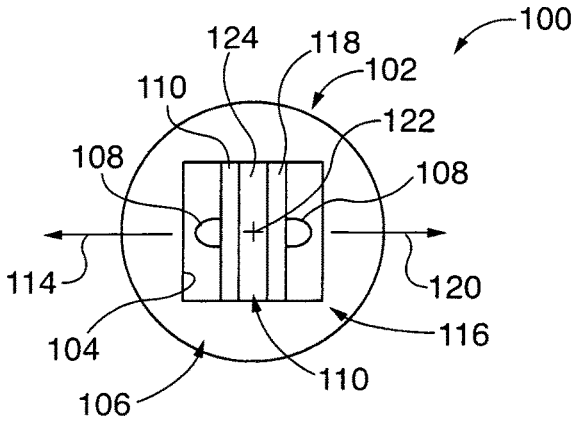
FIG. 2 is an end view of a tube of an illuminated rail, according to at least one aspect of the disclosure.
Figure 5:
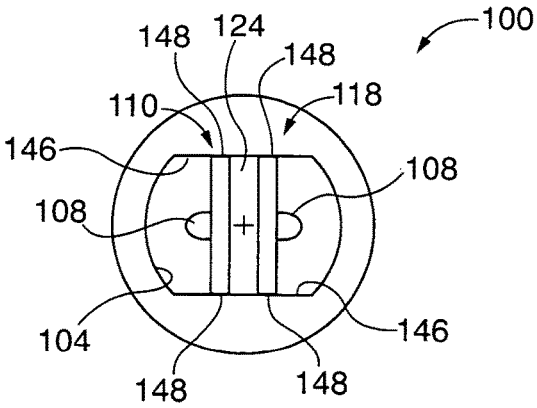
FIG. 5 is a cross sectional view of an illuminated rail, according to a further aspect of the disclosure.

Referring also to FIG. 2, each one of the first series 106 of active lighting elements 108 faces a first radial direction 114 relative to the through passage 194 of the hollow plastic tube 102. The illuminated rail 100 further comprising at least one second series 116 of active lighting elements 108 located within and extending along the through passage 104 of the hollow plastic tube 102. The at least one second series 116 of active lighting elements 108 includes at least one second supporting substrate 118 on which each one of the second series 116 of active lighting elements 108 is mounted. The electric circuit 112 is electrically connected to each one of the second series 116 of active lighting elements 108. Each one of the second series 118 of active lighting elements 108 faces a second radial direction 120 relative to the through passage 104 of the hollow plastic tube 102. The second radial direction 120 is different from the first radial direction 114.

The first and second radial directions 114 and 120 are radial relative to a longitudinal center line 122 of the through passage 104. In this way, light emitted from the first series 106 of active lighting elements 108 can be readily seen from one side of the illuminated rail 100, and light emitted from the second series 116 of active lighting elements 108 can be readily seen from another side of the illuminated rail 100.

Where two series 106 and 116 are arranged back-to-back, as seen in FIG. 2, the illuminated rail 100 further comprises a resilient cushion 124 located between the first series 106 of active lighting elements 108 and the second series 116 of active lighting elements 108. The resilient cushion 124 both protects electronic components from shock and also spaces apart the first and second series 106, 116 of active lighting elements 108 so that the assembly formed thereby, in combination with the resilient cushion 124, takes up most of the volume of the through passage 104. This prevents the first and second series 106, 116 of active lighting elements 108 from twisting and/or rotating within the through passage 104. If not prevented, twisting and/or rotating could damage the first and second series 106, 116 of active lighting elements 108, or might cause the active elements 108 to change in direction of light emission.

The resilient cushion is 124 is coupled to at least one of the first series 106 of active lighting elements and the second series of active lighting elements. This may be accomplished by adhesive (not shown), for example.

In the example of FIG. 2, the resilient cushion 124 is coupled to both of the first series 106 of active lighting elements 108 and the second series 116 of active lighting elements 108. For example, the adhesive may be applied to opposed sides of the resilient cushion 124 to maximally stabilize the first and second series 106, 116 of active lighting elements 108 against twisting and rotation.

The electrical circuit 112 carries both operating electrical power and also control signals controlling illumination of each one of at least the first series 116 of active lighting elements. Where two series 106, 116 of active lighting elements 108 are provided, the electrical circuit 112 carries both operating electrical power and also control signals controlling illumination of each one of the second series 116 of active lighting elements 108 independently of illumination of each one of the first series 106 of active lighting elements 108.

Power and control signals may comprise different signals or electrical currents, or alternatively, may be the same. That is, turning power pulses on and off may be utilized both to power the active lighting elements 108 and also to control when the active lighting elements 108 are illuminated.

Figure 4:
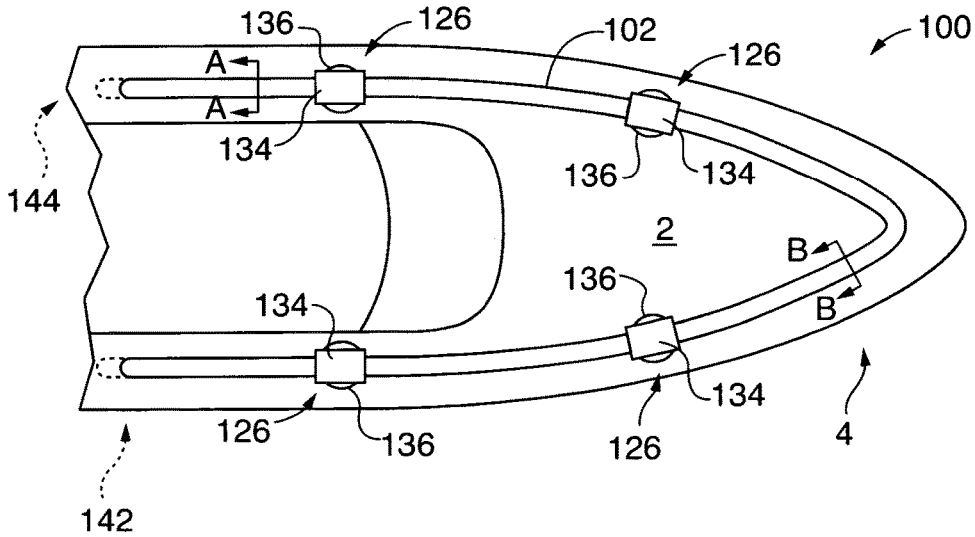
FIG. 4 is is a top plan view of the illuminated rail and boat of FIG. 3, according to at least one aspect of the disclosure.

Referring to FIGS. 1 and 3, the illuminated rail 100 further comprises at least one support stanchion 126 coupled to the hollow plastic tube 102. Each one of the at least one support stanchion 126 has a first end 128 engaging the plastic tube 102, and a second end 130 having means 132 for being fastened to an environmental object 2. The first end 128 of one support stanchion 126 may comprise a socket or sleeve 134 which slips over the hollow plastic tube 102, and adhered or otherwise fastened for engagement thereto. Where the environmental object 2 being provided with the illuminated rail 100 is a boat, as seen in FIGS. 3 and 4, the means 132 for being fastened to the environmental object 2 may be for example a flange 136 bearing holes 138 for receiving fasteners 140 such as bolts, rivets, expansion pins, and the like.

Referring specifically to FIG. 1, the hollow plastic tube 102 has a first end 142 and a second end 144, and is of monolithic construction devoid of joints between the first end 142 and the second end 142. Each one of the at least one support stanchion 126 is between the first end 142 of the hollow plastic tube 102 and the second end 144 of the hollow plastic tube 102. In this way, the hollow plastic tube 102 remains strong and watertight along its length L. This applies to the hollow plastic tube 102 as shown in the example of FIGS. 3 and 4. As seen in FIG. 4, the hollow plastic tube 102 is V-shaped (as seen in the plan view of FIG. 4) to match an external contour of a prow 4 of the boat 2 when the hollow plastic tube 102 is placed in overlying relationship over the prow 4 of the boat 2.

It would be possible to utilize two or more separate hollow plastic tubes 102 complementing one another to form the V-shape (this option is not shown). Each of these two or more separate hollow plastic tubes 102 would of course have its own independent through passage 104, series 106 of active lighting elements 108, and supporting conductors and controls where necessary or desired. Two separate hollow plastic tubes 102 could share a common support stanchion 126 at the prow 4 of the boat 2.

Referring particularly to FIG. 3, the through passage 104 extends continuously through the hollow plastic tube 102 and continuously along the length L of the hollow plastic tube 102, and is non-circular in cross sections taken along the length L of the hollow plastic tube 102. A non-circular through passage 104 enables the assembly including the first and second series 106, 116 to be prevented from rotating and twisting within the through passage 104. Any one of many non-circular cross sectional configurations may be utilized. For example, as seen in FIG. 1, the through passage 104 extending continuously through the hollow plastic tube 102 and continuously along the length L of the hollow plastic tube 102 is rectangular in cross sections (such as cross sections A-A and B-B called out in FIG. 4) taken along the length L of the hollow plastic tube 102.

The through passage 104 extending continuously through the hollow plastic tube 102 and continuously along the length L of the hollow plastic tube 102 may comprise at least a flat facet 146 considered in cross sections taken along the length L of the hollow plastic tube 102 (e.g., the cross sections A-A and B-B in FIG. 4). The flat facets 146 enable the first and second supporting substrates 110, 118 to lodge sufficiently firmly against the interior surface of the through passage 104 so as to preclude twisting and/or rotation. At least one of the first supporting substrate 110 of the first series 106 of active lighting elements 108 and the second supporting substrate 118 of the second series 116 of active lighting elements 108 comprises a flat face 148 abutting the flat facet 146 of the through passage 104 extending continuously through the hollow plastic tube 102 and continuously along the length L of the hollow plastic tube 102. This construction stabilizes the first and second series 106, 116 of active lighting elements 108 within the through passage 104 by engaging the flat facets 146 of the through passage 104.

Figure 6:
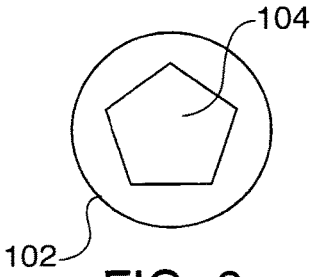
FIG. 6 is a cross sectional view of an illuminated rail, according to another aspect of the disclosure.
Figure 7:
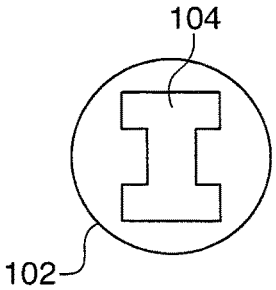
FIG. 7 is a cross sectional view of an illuminated rail, according to still another aspect of the disclosure.
Figure 8:
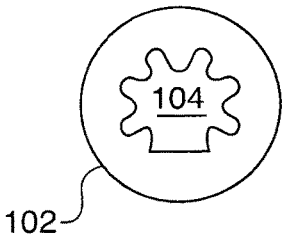
FIG. 8 is a cross sectional view of an illuminated rail, according to yet another aspect of the disclosure.
Figure 10:
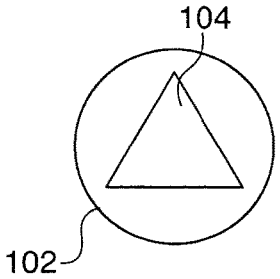
FIG. 10 is a cross-sectional view of an illuminated rail, according to a further aspect of the disclosure.

Still other cross sectional configurations of the through passage 104 are possible. As seen in FIG. 6, the through passage 104 may have a cross sectional configuration of a regular polygon. As seen in FIG. 6, the through passage 104 may have an "H" or "I" shaped cross sectional configuration, or other profile having both convexities and concavities. As seen in FIG. 8, the through passage 104 may have curved elements combined with straight elements.

Figure 9:
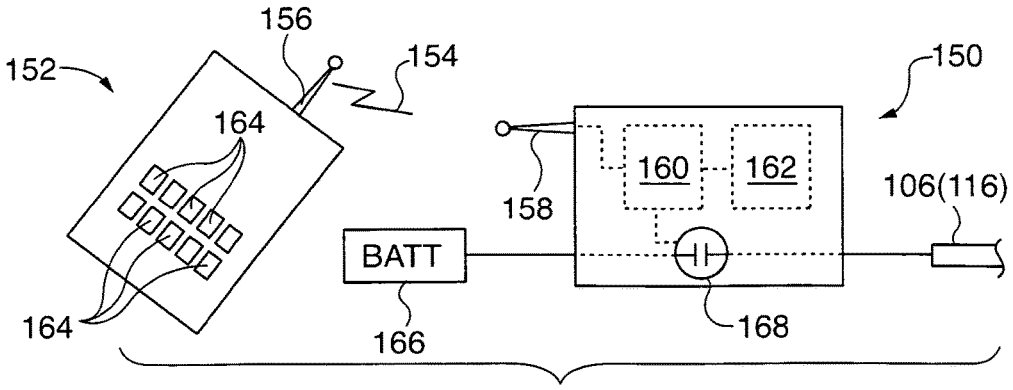
FIG. 9 is a diagrammatic view of electrical aspects of an illuminated rail, according to at least one other aspect of the disclosure.

Referring once again to FIG. 3 and also to FIG. 9, the illuminated rail 100 may further comprise a controller 150 hard wired to and operable to illuminate at least the first series 106 of active lighting elements 108, and a user interface 152 operable to receive commands from a person (not shown) using the illuminated rail 100 and to transmit the commands to the controller as signals 154 selectively illuminating at least the first series 106 of active lighting elements 108. In illuminated rails 100 having first and second series 106, 116 of active lighting elements, the user interface 152 and controller 150 would control both. Using antennae 156, 158, the user interface 152 transmits the commands to the controller 150 wirelessly.

The controller 150 comprises a data processor 160 and a memory 162, and computer instructions loaded into the memory 162. The computer instructions are operable to selectively illuminate at least the first series 106 of acting lighting elements 108 according to at least one pre-established sequence, loaded into the memory 162 and capable of being processed by the data processor 160 to generate power and control signals 154 corresponding to the commands received by the user interface 152. The user interface 152 includes input devices such as keys 164 which can be manually depressed to enter commands into the user interface 152. The user interface 152 may be provided with the controller 150 (although as a physically separate component, such as a remote controller for audiovisual equipment), or alternatively, may comprise a personal communications device such as a cellular phone.

The controller 150 may comprise an electrical microprocessor made for example by Arduino. Arduino is an open-source electronics platform based on easy-to-use hardware and software. Arduino is a commercial entity which intends its products for use by those creating projects having interactive features. Commercially available programming products of Arduino may be found online for example at a retailer such as Adafruit Industries (https://www.adafruit.com/products/191). Arduino product Mega 2560 R3 (Atmega 2560, assembled), product number 191, has proved satisfactory in the role of controller 150.

The first and second series 106, 116 of active lighting elements 108 may comprise LED strip products also available from Adafruit Industries, such as NeoPixel digital RGB LED strip, product identification 1461 (https://www.adafruit.com/products/1461).

The controller 150 is connected to a battery 166 carried on the boat 2 and to the first and second series 106, 116 of active lighting elements 108. The controller 150 may include a switch (shown as normally open contacts 168) to connect the first and second series 106, 116 of active lighting elements 108 to electrical power. If additional series (not shown) of active lighting elements 108 are provided, each of these would be operably connected to power and, where necessary, control signals. Where power and control signals are not one and the same, the controller 150 will be understood to provide both types of signals. Some lighting assemblies (e.g., including the series 106 or 116 of active lighting elements 108) may have internal electronic components (not shown) which respond to control signals generated by the controller 150, for example, to switch individual active lighting elements 108 on and off, and to change colors thereof.

The illuminated rail 100 has been described herein in connection with the boat 2. It should be understood that the illuminated rail 100 may be used for attachment to other types of transport vehicles, such as ships, underwater boats, motorized and unpowered wheeled or tracked land vehicles, and aircraft (none of these examples is shown). The illuminated rail 100 may be used with elevators, escalators, and moving sidewalks. Also, the illuminated rail 100 may be used with static structures such as buildings, stairways and walkways, docks, piers, large scale platforms and scaffolds, industrial equipment such as large scale storage tanks and processing apparatus, and mobile structures such as tents, ladders, small scale or temporary scaffolds.

While the disclosed concepts have been described in connection with what is considered the most practical and preferred implementation, it is to be understood that the disclosed concepts are not to be limited to the disclosed arrangements, but are intended to cover various arrangements which are included within the spirit and scope of the broadest possible interpretation of the appended claims so as to encompass all modifications and equivalent arrangements which are possible.

It should be understood that the various examples of the apparatus(es) disclosed herein may include any of the components, features, and functionalities of any of the other examples of the apparatus(es) disclosed herein in any feasible combination, and all of such possibilities are intended to be within the spirit and scope of the present disclosure. Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims.

Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

We claim:

1. An illuminated rail for attachment to an object, comprising:

a hollow translucent tube having a length L and comprising an through passage extending continuously through the hollow translucent tube and continuously along the length of the hollow translucent tube;

at least one first series of active lighting elements comprising light emitting diodes located within and extending along the through passage of the hollow translucent tube, wherein the at least one first series of active lighting elements includes at least one first supporting substrate on which each one of the first series of active lighting elements is mounted; and an electrical circuit electrically connected to each one of the series of active lighting elements and located within and extending along the through passage of the hollow translucent tube, wherein the hollow translucent tube is V-shaped to match an external contour of a prow of a boat when the hollow translucent tube is placed in overlying relationship over the prow of the boat, wherein each one of the first series of active lighting elements faces a first radial direction relative to the through passage of the hollow translucent tube, the illuminated rail further comprising at least one second series of active lighting elements located within and extending along the through passage of the hollow translucent tube, and further wherein:

the at least one second series of active lighting elements includes at least one second supporting substrate on which each one of the second series of active lighting elements is mounted;

the electric circuit is electrically connected to each one of the second series of active lighting elements, and each one of the second series of active lighting elements faces a second radial direction relative to the through passage of the hollow translucent tube, the second radial direction being different from the first radial direction.

2. The illuminated rail of claim 1, further comprising a resilient cushion located between the first series of active lighting elements and the second series of active lighting elements.

3. The illuminated rail of claim 2, wherein the resilient cushion is coupled to at least one of the first series of active lighting elements and the second series of active lighting elements.

4. The illuminated rail of claim 2, wherein the resilient cushion is coupled to both of the first series of active lighting elements and the second series of active lighting elements.

5. The illuminated rail of claim 1, wherein the electrical circuit carries both operating electrical power and also control signals controlling illumination of each one of at least the first series of active lighting elements.

6. The illuminated rail of claim 1, wherein the electrical circuit carries both operating electrical power and also control signals controlling illumination of each one of the second series of active lighting elements independently of illumination of each one of the first series of active lighting elements.

7. The illuminated rail of claim 1, further comprising at least one support stanchion coupled to the hollow translucent tube, each one of the at least one support stanchion having a first end engaging the hollow translucent tube, and a second end having means for being fastened to an environmental object.

8. The illuminated rail of claim 7, wherein the hollow translucent tube has a first end and a second end, and is of monolithic construction devoid of joints between the first end and the second end, and each one of the at least one support stanchion is between the first end of the hollow translucent tube and the second end of the hollow translucent tube.

9. The illuminated rail of claim 1, wherein the through passage extending continuously through the hollow translucent tube and continuously along the length of the hollow translucent tube is non-circular in cross sections taken along the length of the hollow translucent tube.

10. The illuminated rail of claim 9, wherein the through passage extending continuously through the hollow translucent tube and continuously along the length of the hollow translucent tube is rectangular in cross sections taken along the length of the hollow translucent tube.

11. The illuminated rail of claim 9, wherein the through passage extending continuously through the hollow translucent tube and continuously along the length of the hollow translucent tube comprises at least a flat facet considered in cross sections taken along the length of the hollow translucent tube.

12. The illuminated rail of claim 11, wherein at least one of the first supporting substrate and the second supporting substrate comprises a flat face abutting the flat facet of the through passage extending continuously through the hollow translucent tube and continuously along the length of the hollow translucent tube.

13. The illuminated rail of claim 1, wherein each one of the first series of active lighting elements comprises a multicolor light emitting diode.

14. The illuminated rail of claim 1, wherein each one of the second series of active lighting elements comprises a multicolor light emitting diode.

15. The illuminated rail of claim 1, further comprising:

a controller hard wired to and operable to illuminate at least the first series of active lighting elements; and a user interface operable to receive commands from a person using the illuminated rail and to transmit the commands to the controller to selectively illuminate the first series of active lighting elements.

16. The illuminated rail of claim 15, wherein the user interface transmits the commands to the controller wirelessly.

17. The illuminated rail of claim 15, wherein the controller comprises:

a data processor and a memory; and computer instructions loaded into the memory in a non-transitory computer-readable medium that when executed, are configured to instruct the processor to selectively illuminate at least the first series of acting lighting elements according to at least one pre-established sequence, loaded into the memory and capable of being processed by the data processor to generate power and control signals corresponding to the commands received by the user interface.

* * * * *